US008085213B2

(12) United States Patent
Wu et al.

(10) Patent No.: US 8,085,213 B2
(45) Date of Patent: Dec. 27, 2011

(54) LOW NOISE BLOCK CONVERTER FEEDHORN

(75) Inventors: Tsan-Chou Wu, Taipei Hsien (TW); Wen-Tsai Tsai, Taipei Hsien (TW); Chen-Yueh Chen, Taipei Hsien (TW)

(73) Assignee: Wistron Neweb Corp., Taipei Hsien (TW)

( * ) Notice: Subject to any disclaimer, the term of this patent is extended or adjusted under 35 U.S.C. 154(b) by 361 days.

(21) Appl. No.: 12/385,034

(22) Filed: Mar. 30, 2009

(65) Prior Publication Data

US 2010/0001816 A1 Jan. 7, 2010

(30) Foreign Application Priority Data

Jul. 4, 2008 (TW) ..... 97125245 A

(51) Int. Cl.
*H01Q 13/00* (2006.01)

(52) U.S. Cl. ..... 343/786; 343/784

(58) Field of Classification Search ..... 343/786, 343/772, 784, 840; 331/107 DP, 155
See application file for complete search history.

(56) References Cited

U.S. PATENT DOCUMENTS

| | | | | |
|---|---|---|---|---|
| 5,216,388 | A | 6/1993 | Dipoala | |
| 6,657,505 | B2 * | 12/2003 | Denis et al. | 331/107 DP |
| 6,720,933 | B2 | 4/2004 | Hanlin et al. | |
| 2002/0190804 | A1 * | 12/2002 | Denis et al. | 331/100 |
| 2007/0164841 | A1 | 7/2007 | Juang et al. | |

OTHER PUBLICATIONS

Office Action dated May 27, 2011 issued in corresponding Taiwanese application No. 097125245.

* cited by examiner

*Primary Examiner* — Hoanganh Le
(74) *Attorney, Agent, or Firm* — Bacon & Thomas, PLLC

(57) ABSTRACT

A low noise block converter feedhorn (LNBF) is disclosed. The LNBF comprises a PCB, a dielectric resonator oscillator (DRO), a chamber, a tuning screw, and a cover. The DRO is placed on the PCB. The chamber has a first partition, and the first partition is used to cover up the DRO. The chamber further comprises a round hole. The tuning screw passes through the round hole and is then used to adjust the oscillating frequency of the DRO. The cover is used to cover up the tuning screw in order to restrain the DRO from power leakage through the gap in between the round hole and the tuning screw.

6 Claims, 9 Drawing Sheets

LOW NOISE BLOCK CONVERTER FEEDHORN

BACKGROUND OF THE INVENTION

1. Field of the Invention

The present invention relates to a low noise block converter feedhorn (LNBF), and more particularly, to an LNBF which can restrain power leaked out from a dielectric resonator oscillator (DRO).

2. Description of the Related Art

Due to technology advancement and improvement on the standard of living, satellite antennas have become prevalent and have been widely installed. Generally, after satellite signals are reflected by a round satellite dish, the reflected signals are received and gathered by a Low Noise Block Converter Feedhorn (LNBF), which are then transmitted to other receivers such as televisions.

The LNBF comprises a Dielectric Resonator Oscillators (DRO). The DRO is used to adjust the oscillating frequency of the signals received from the satellites; the signals are then transmitted to the other receivers. In the prior art, the DRO employs a tuning screw to tune the oscillating frequency. However, there is a high possibility of power leakage from the DRO through the aforesaid method. The power radiation of power leakage will be reabsorbed by the satellite antenna and will cause signal interferences.

A method is disclosed in the prior art to solve the aforesaid problems. Refer to FIG. 1 for the diagram relating to an LNBF of the prior art. As shown in the prior art, a large shield 91 is used by an LNBF 90 to cover up a DRO 92 and other electronic elements in order to restrain power leakage from DRO 92. However, the covering method through the use of shield 91 is expensive and the tuning process of DRO 92 is difficult.

Therefore, a new design is needed to resolve the problems in the prior art.

SUMMARY OF THE INVENTION

The object of the present invention is to provide a LNBF which will be able to restrain power leakage from a DRO.

In order to achieve the aforementioned objective, the invention provides an LNBF which comprises a PCB, a dielectric resonator oscillator (DRO), a chamber, a tuning screw, and a cover. The DRO is placed on the PCB. The chamber has a first partition, and the first partition is used to cover up the DRO. The chamber further comprises a round hole. The tuning screw passes through the round hole and is used to adjust the oscillating frequency of the DRO. The cover is used to cover up the tuning screw to restrain power leakage from the DRO through the gap between the round hole and the tuning screw.

DETAILED DESCRIPTION OF THE PREFERRED EMBODIMENT

The advantages and innovative features of the invention will become more apparent from the following preferred embodiments.

Figure 1:
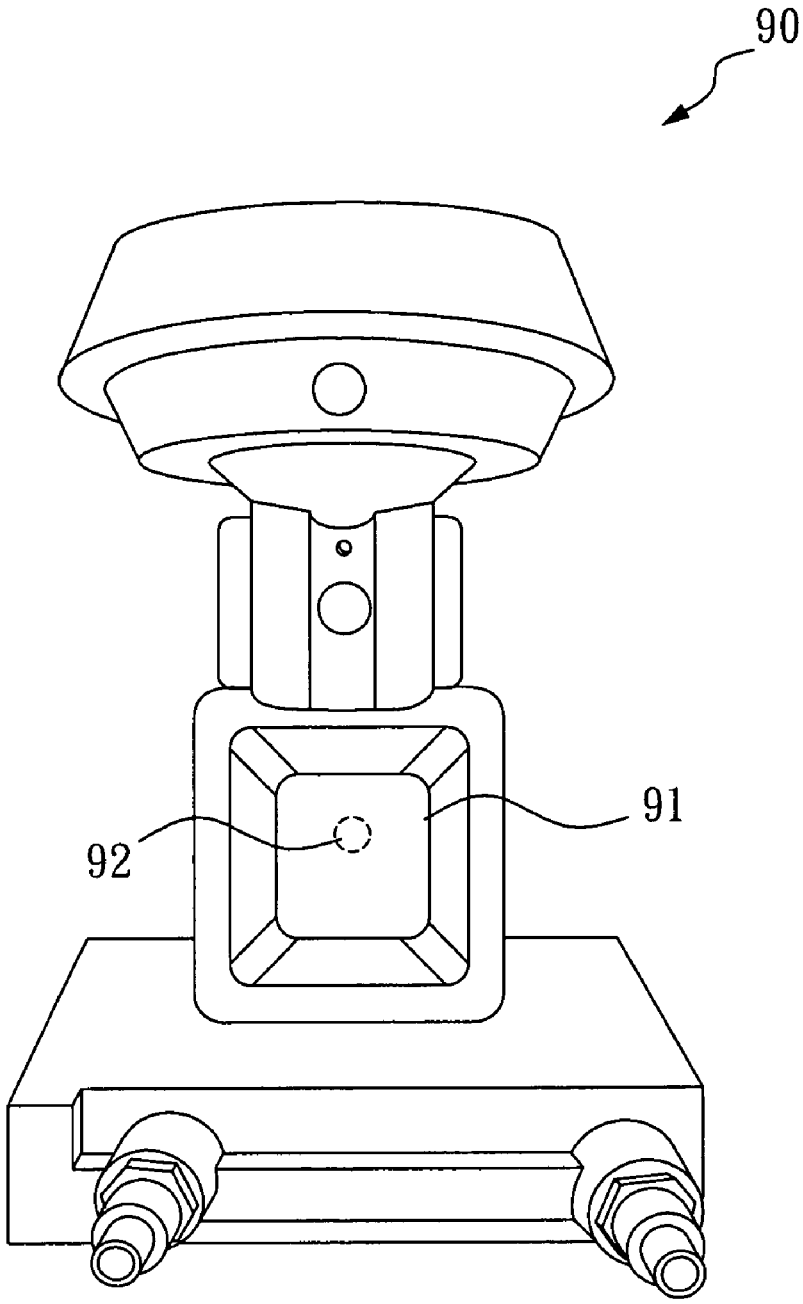
FIG. 1 (Prior Art)
FIG. 1 shows an LNBF of the prior art.
Figure 2A:
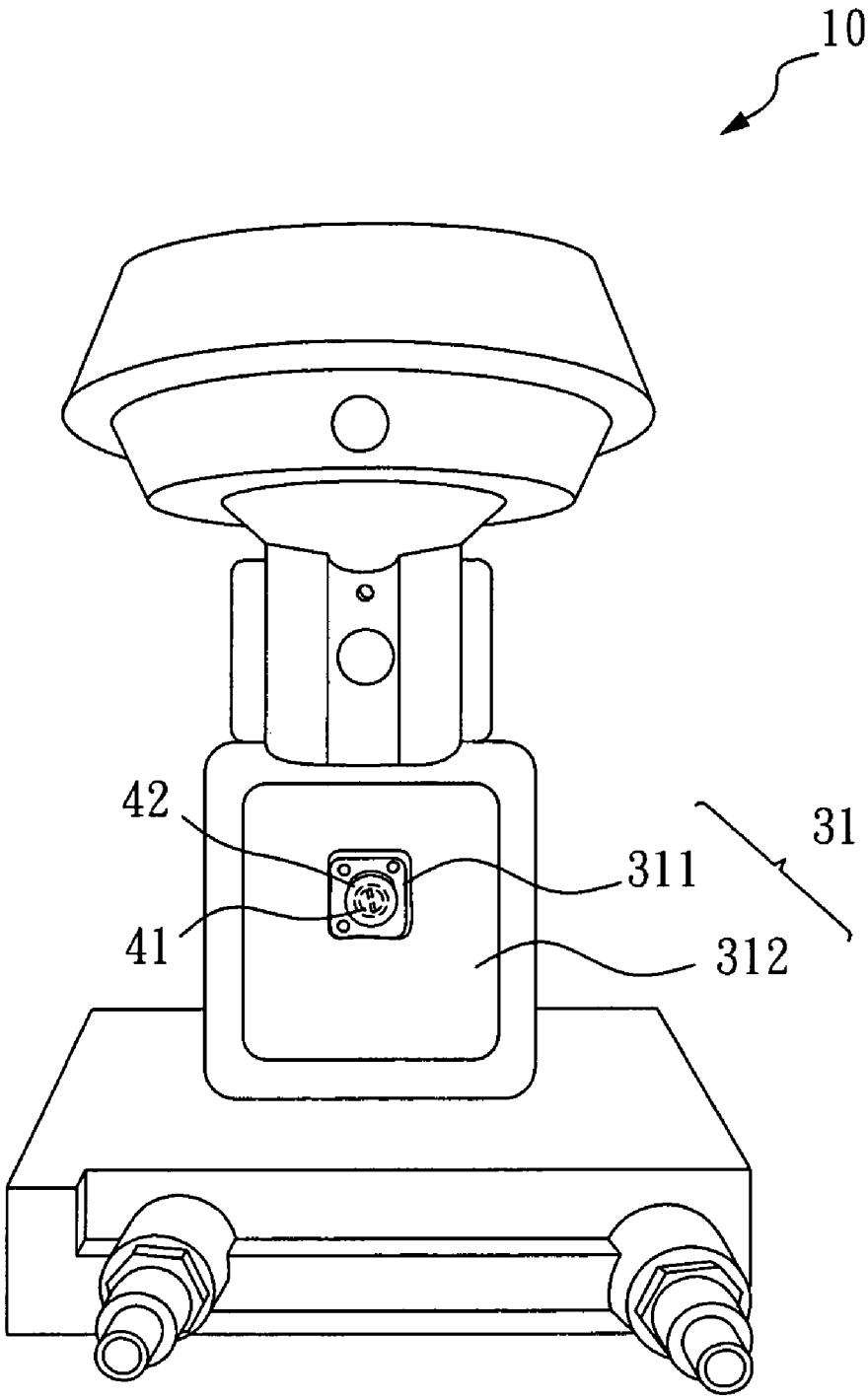
FIG. 2A is an exterior view of an LNBF according to an embodiment of the invention.
Figure 2B:
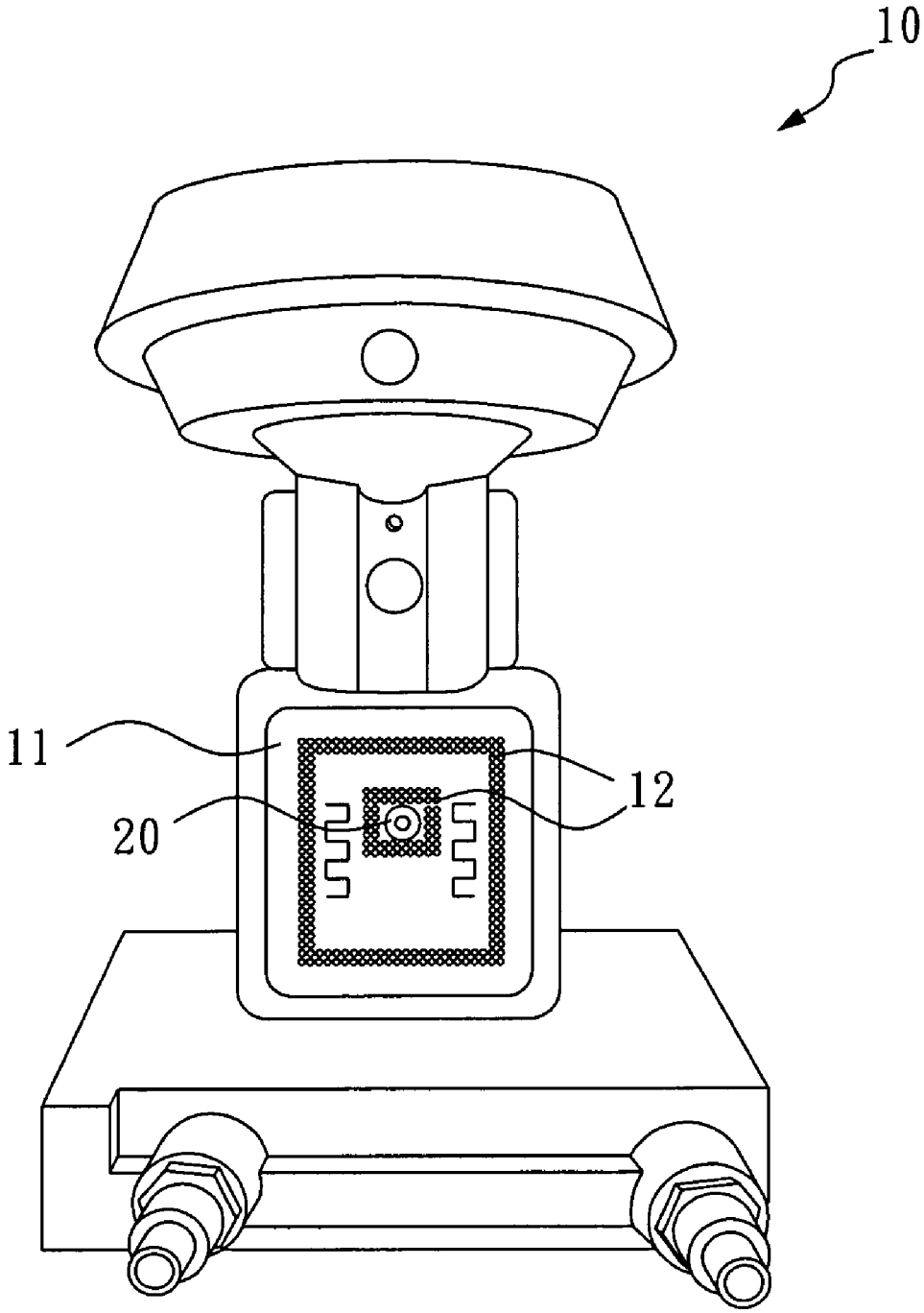
FIG. 2B is an internal circuit diagram of an LNBF according to an embodiment of the invention.

Refer to FIG. 2A and FIG. 2B for the diagrams relating to an LNBF for the invention. FIG. 2A is an exterior view of the LNBF according to an embodiment of the invention; FIG. 2B is an internal circuit diagram of the LNBF according to an embodiment of the invention.

Figure 3A:
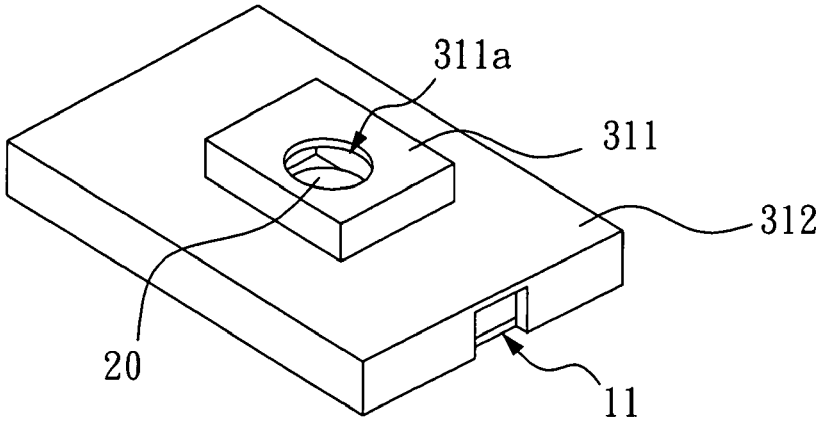
FIG. 3A shows an LNBF without a tuning screw according to an embodiment of the invention.

As shown in FIG. 2A and FIG. 2B, an LNBF 10 according to an embodiment of the invention is used for receiving wireless signals reflected from a round dish (not shown). For example, for receiving satellite signals, but the invention is not only limited to the satellite signals. The LNBF 10 comprises a PCB 11, a DRO 20, a chamber 31, a tuning screw 41, a cover 42 and a plurality of via holes 12. The DRO 20 is made from ceramic compounds, but the invention is not limited to this material. The DRO 20 which is placed on the PCB 11 is used for adjusting the oscillating frequency of the wireless signals received. The chamber 31 comprises a first partition 311 and a second partition 312. The first partition 311 covers up the DRO 20 so as to restrain power leakage from the DRO 20. The second partition 312 covers up the entire PCB 11. A round hole 311*a* is located on partition 31 (as shown in FIG. 3A). The tuning screw 41 passes through the round hole 311*a* to tune the DRO 20.

The cover 42 is placed on top of the tuning screw 41. In the embodiment, the cover 42 is an F type screw or other standardized screws, but the invention is not limited to these screws. The cover 42 is deployed to cover the gap between the tuning screw 41 and the chamber 31; this can prevent the DRO 20 from power leakage through the gap. There are a plurality of via holes 12 placed on the PCB 11 which surround the DRO 20.

The via holes 12 on the PCB 11 are small holes filled or coated with metal, which are used to connect the grounding metal on both sides of the PCB 11 (not shown). Power will be radiated through the gap between the via holes 12 at the pressing boundary when the chamber 31 is pressed against the PCB 11. Therefore, radiation of power can be restrained by a high density of via holes 12.

Figure 3B:
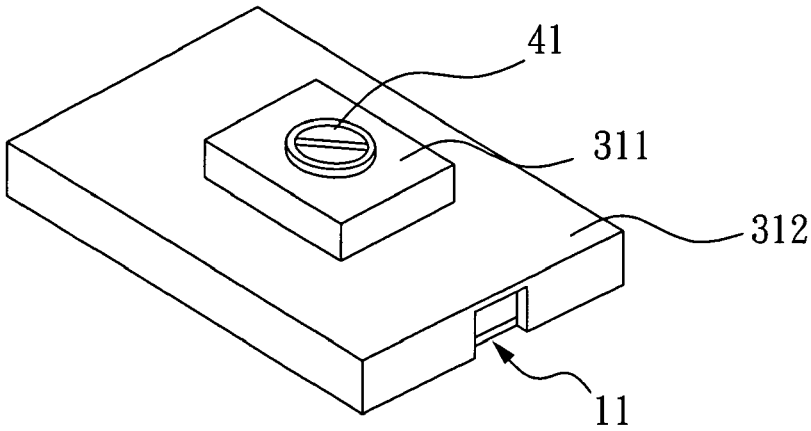
FIG. 3B shows an LNBF with a tuning screw according to an embodiment of the invention.
Figure 3C:
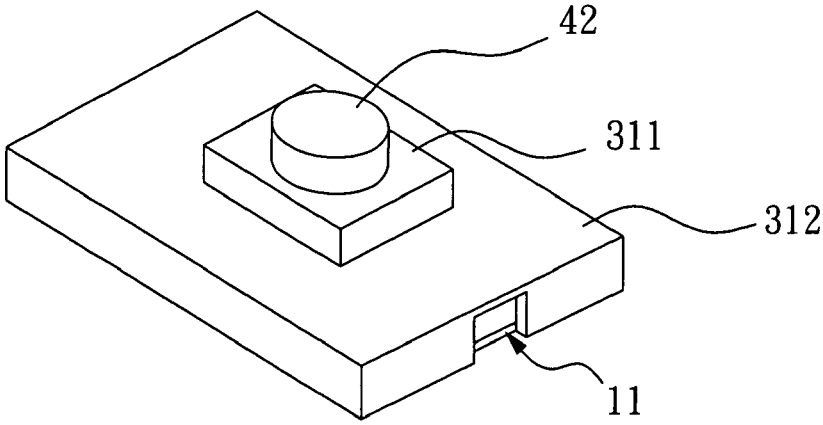
FIG. 3C shows an LNBF with a cover according to an embodiment of the invention.
Figure 4:
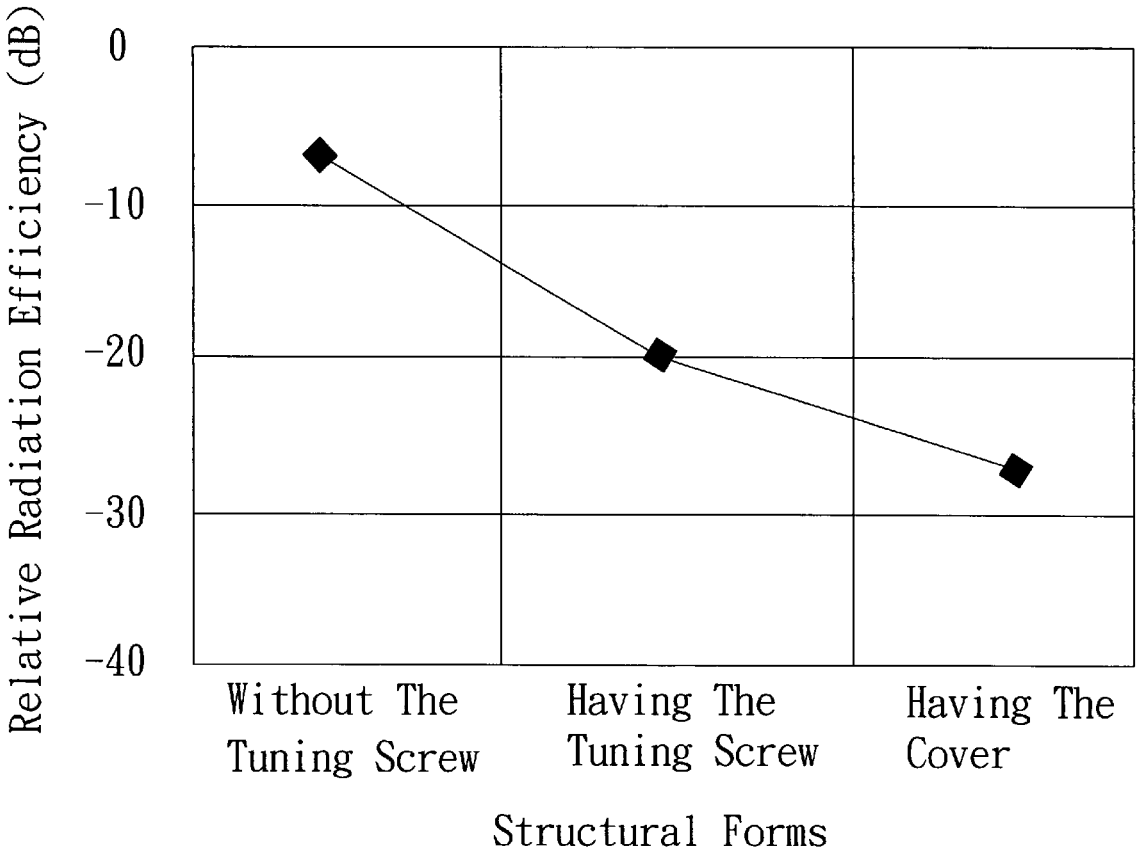
FIG. 4 shows the relative radiation efficiency for different structure of an LNBF in accordance with the invention.

Next, please refer to FIG. 3A~FIG. 3C for the diagrams relating to an LNBF of the invention, and refer to FIG. 4 for the diagram showing the relative radiation efficiency for different structure of the LNBF in accordance with the invention. FIG. 3A is a diagram showing the embodiment of an LNBF without a tuning screw. FIG. 3B is a diagram showing the embodiment of an LNBF with a tuning screw. FIG. 3C is a diagram showing the embodiment of an LNBF with a cover.

As for the embodiments shown in FIG. 3A and FIG. 4, the relative radiation efficiency measured is approximately negative 8 dB if the first partition 311 of the chamber 31 does not connect with the tuning screw 41. It means that some of the power from the DRO 20 is radiated through the round hole 311*a*. For the embodiment as shown in FIG. 3B, the relative radiation efficiency measured is reduced to approximately negative 20 dB if the tuning screw 41 is inserted at the round hole 311*a*. However, some of the power is radiated through the gap between the round hole 311*a* and the tuning screw 41. Therefore, an embodiment of the invention is shown in FIG. 3C. As shown in FIG. 3C, power leakage from the DRO 20 is restrained by covering the tuning screw 41 with the cover 42. The relative radiation efficiency measured is reduced to approximately negative 30 dB. In the invention, the cover 42 is a standardized screw nut which simplifies the assembly and the removal process, and it is therefore convenient to tune the DRO 20.

Figure 5:
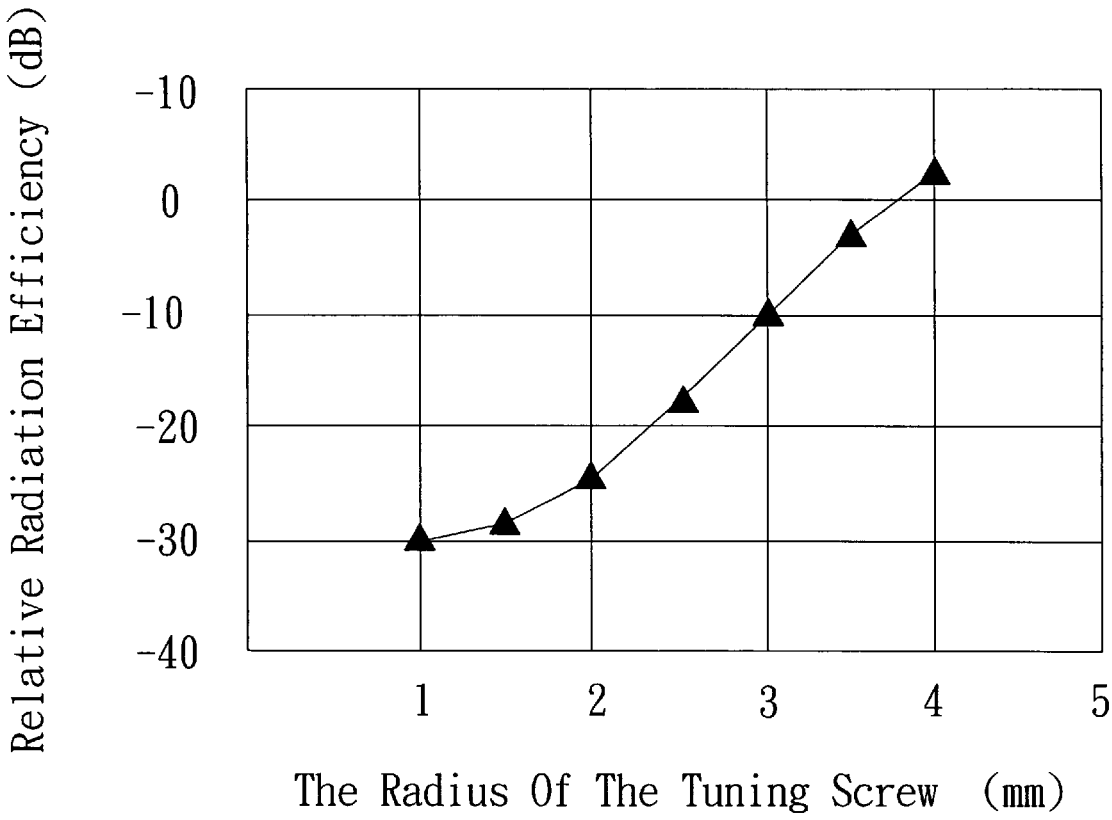
FIG. 5 shows the relationship between the relative radiation efficiency and the radius of the tuning screw of an LNBF for the invention.

Next, refer to FIG. 5 which shows the relationship between the relative radiation efficiency and the radius of the tuning screw of the LNBF for the invention.

The invention has set a constraint on the radius of tuning screw 41. As shown in FIG. 5, it can be seen that when the radius of the tuning screw 41 is shorter, the relative radiation efficiency measured will be less, which means that less power will be radiated from the gap between the tuning screw 41 and the chamber 31. In the embodiment of the invention, the radius of tuning screw 41 ranges from 1 mm to 2 mm.

Figure 6:
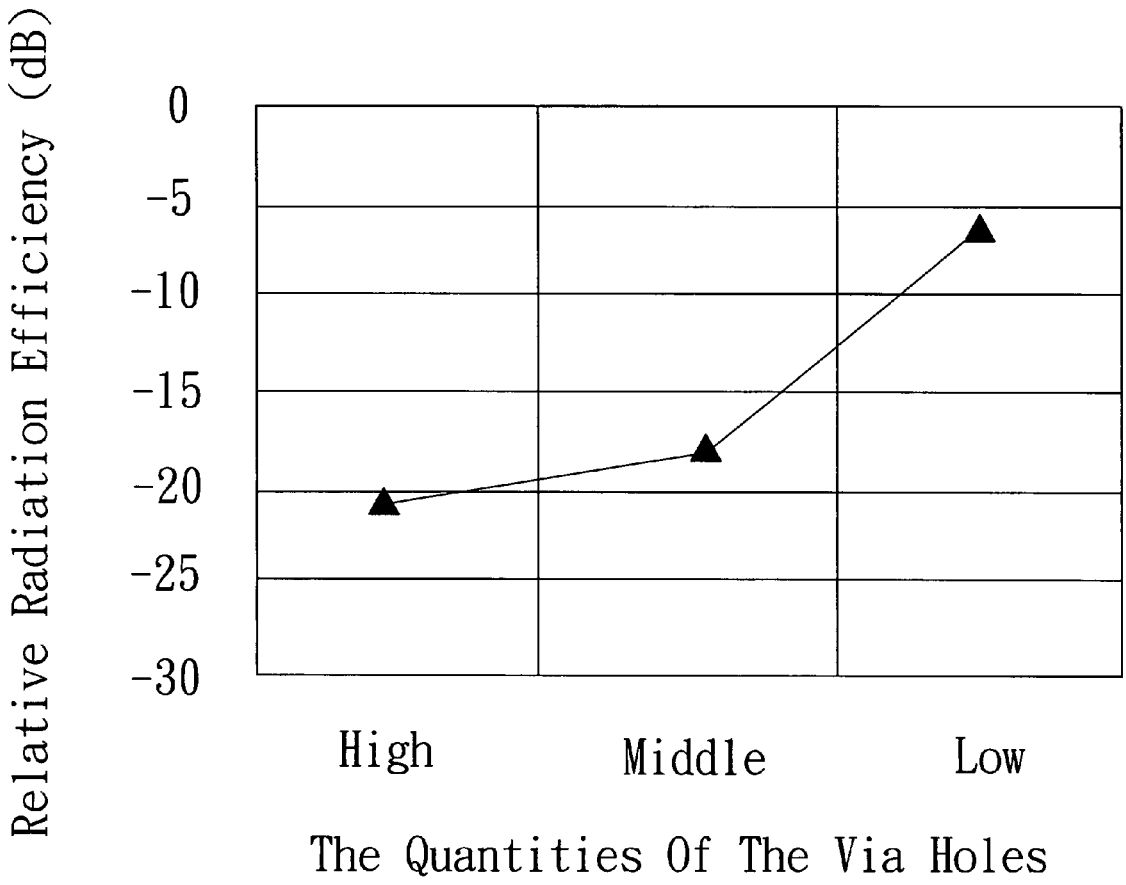
FIG. 6 shows the relationship between the relative radiation efficiency and the quantities of the via holes of an LNBF for the invention.

Next, refer to FIG. 6 which shows the relationship between the relative radiation efficiency and the quantities of the via holes of the LNBF for the invention.

The quantities and density of via holes 12 have an effect on the relative radiation efficiency measured. Power will be radiated through the gap between the via holes 12 at the pressing boundary when the chamber 31 is pressed against the PCB 11. As shown in FIG. 6, the higher the density of the via holes 12 at the pressing boundary, the less relative radiation efficiency will be measured and power leakage from the DRO 20 through the sides of the PCB 11 will also be reduced. Therefore, as shown in FIG. 2B, the embodiment of the invention consists of a high density of the via holes 12.

Figure 7A:
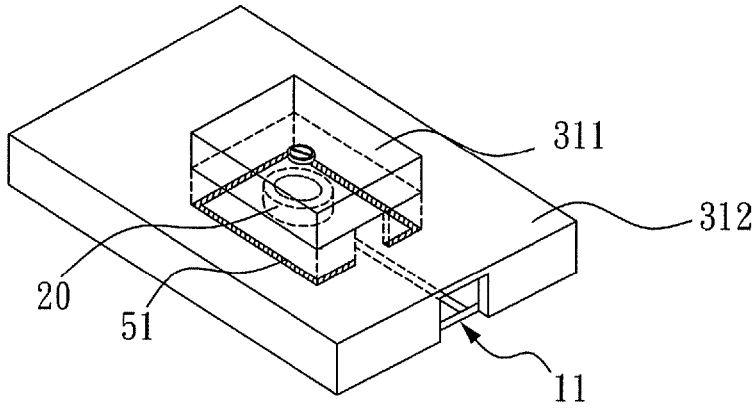
FIG. 7A is an embodiment of an LNBF for the invention which connects the first partition to the ground.
Figure 7B:
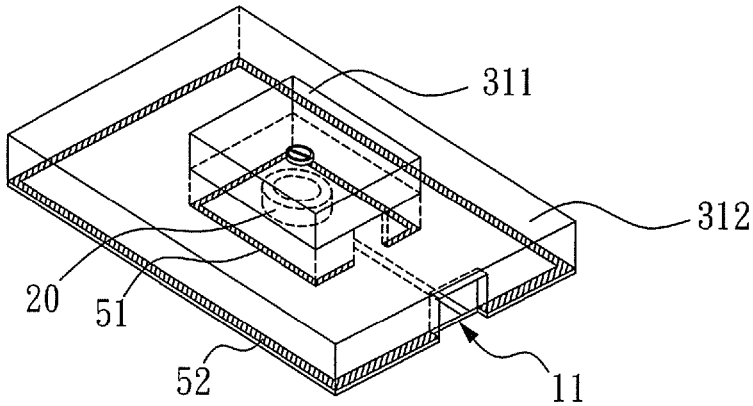
FIG. 7B is an embodiment of an LNBF for the invention which connects the second partition to the ground.
Figure 7C:
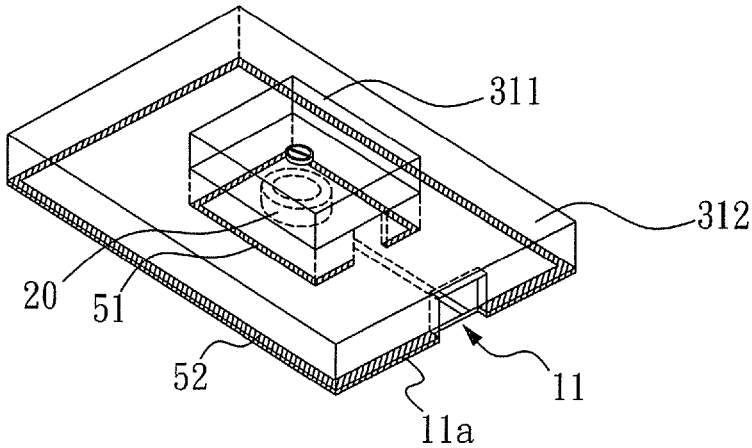
FIG. 7C is an embodiment of an LNBF for the invention which connects the edge of the PCB boarder to the ground.
Figure 8:
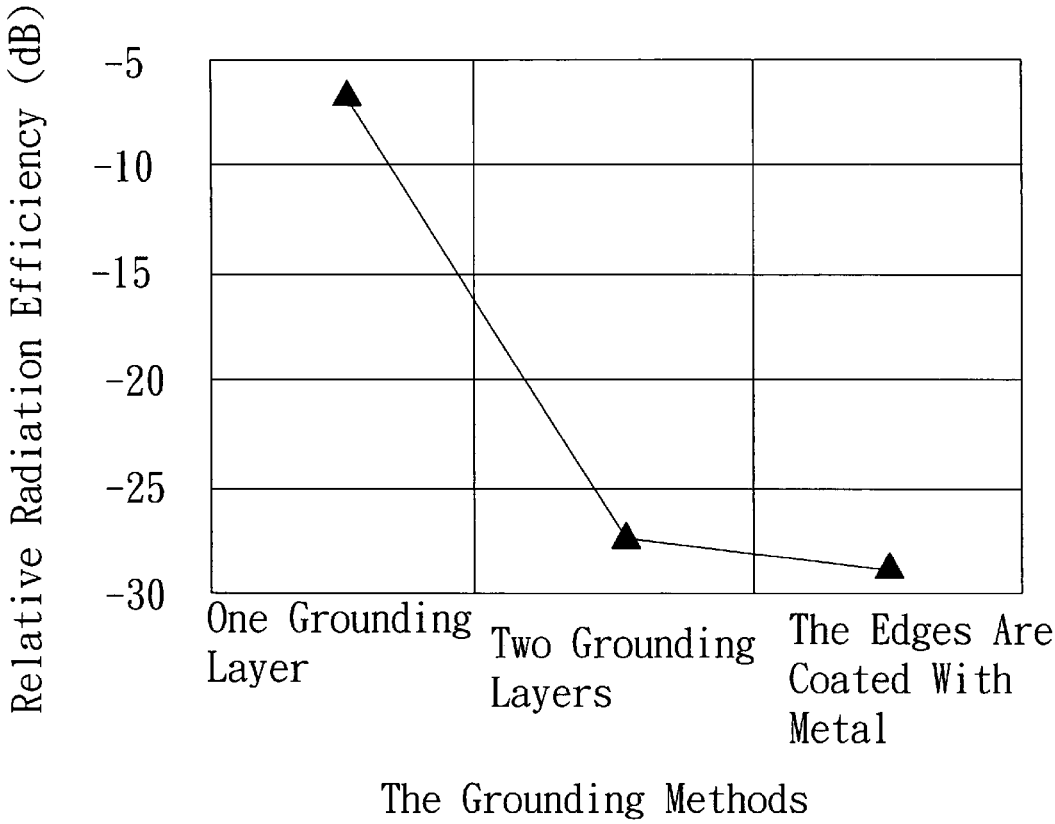
FIG. 8 shows the relationship between the relative radiation efficiency and the grounding methods of an LNBF for the invention.

Next, refer to FIG. 7A~7C which show the grounding methods for a LNBF of the invention and refer to FIG. 8 which shows the relationship between the relative radiation efficiency and the grounding methods of an LNBF for the invention. FIG. 7A shows the embodiment which connects the first partition to the ground. FIG. 7B shows the embodiment which connects the second partition to the ground. FIG. 7C shows the embodiment which connects the PCB edges to the ground.

Refer to the embodiments shown in FIG. 7A and in FIG. 8, which show the relationship between the relative radiation efficiency and the grounding methods of the LNBF for the invention. If the pressing boundary 51 between the first partition 311 of the chamber 31 and the PCB 11 is coated with metal, a separation layer can be formed when the chamber 31 and the PCB 11 are pressed together, which will be used for grounding purpose. However, this configuration is not very effective in terms of restraining power leakage, as the relative radiation efficiency measured is approximately 6 dB. Refer to the embodiment shown in FIG. 7B. If the pressing boundary 52 between the second partition 312 and the PCB 11 is coated with metal, a second sealed separation layer will be formed which can then be used for grounding purpose. Power could be prevented from radiating through the sides of the PCB 11 and the relative radiation efficiency measured will be reduced to approximately 25 dB. The embodiment is shown in FIG. 7C, where the edges 11*a* of the PCB 11 are coated with metal for grounding purposes. The relative radiation efficiency measured is reduced to approximately 29 dB, thus the optimal power restraining effect will be obtained.

Through the embodiments of the LNBF for the invention, power can be prevented from radiating through the gap between the round hole 311*a* and the tuning screw 41, or through the sides of the PCB 11. Therefore power leakage from the DRO 20 will be minimized.

Although the present invention has been explained in relation to its preferred embodiment, it is also to be understood that many other possible modifications and variations can be made without departing from the spirit and scope of the invention as hereinafter claimed.

What is claimed is:

1. A low noise block converter feedhorn comprising:

a printed circuit board;

a dielectric resonator oscillator placed on the printed circuit board;

a chamber comprising a first partition used to cover up the dielectric resonator oscillator, wherein a pressing boundary between the first partition and the printed circuit board is coated with metal and is used for grounding purposes, wherein the chamber further comprises a round hole and a second partition, wherein the second partition is used to cover up the printed circuit board;

a tuning screw which passes through the round hole and is used to adjust the oscillating frequency of the dielectric resonator oscillator; and a cover which is used to cover up the tuning screw to restrain the dielectric resonator oscillator from power leakage through the gap between the round hole and the tuning screw.

2. The low noise block converter feedhorn as claimed in claim 1, wherein the cover is an F type screw.

3. The low noise block converter feedhorn as claimed in claim 1, wherein the radius of the tuning screw is between 1 mm to 2 mm.

4. The low noise block converter feedhorn as claimed in claim 1, wherein the printed circuit board further comprises a high density of via holes.

5. The low noise block converter feedhorn as claimed in claim 1, wherein a pressing boundary between the second partition and the printed circuit board is coated with metal and is used for grounding purposes.

6. The low noise block converter feedhorn as claimed in claim 5, wherein an edge of the printed circuit board is coated with metal for grounding purposes.

* * * * *